US009957467B2

(12) United States Patent
Di Capua et al.

(10) Patent No.: US 9,957,467 B2
(45) Date of Patent: May 1, 2018

(54) HARD SURFACE CLEANERS COMPRISING ETHOXYLATED ALKOXYLATED NONIONIC SURFACTANTS

(71) Applicant: The Procter & Gamble Company, Cincinnati, OH (US)

(72) Inventors: Gloria Di Capua, Ardea (IT); Geert Andre Deleersnyder, Wielsbeke (BE); Stefanos Kantaridis, Brussels (BE); Felicetta Landi, Brussels (BE); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 41 days.

(21) Appl. No.: 14/926,137

(22) Filed: Oct. 29, 2015

(65) Prior Publication Data

US 2016/0122688 A1 May 5, 2016

(30) Foreign Application Priority Data

Oct. 29, 2014 (EP) ..... 14190783
Sep. 2, 2015 (EP) ..... 15183431
Oct. 21, 2015 (WO) ..... PCT/US2015/056663

(51) Int. Cl.

| | |
|---|---|
| ***B08B 3/00*** | (2006.01) |
| ***C11D 1/83*** | (2006.01) |
| *C11D 1/74* | (2006.01) |
| *C11D 11/00* | (2006.01) |
| *C11D 1/66* | (2006.01) |
| *C11D 1/722* | (2006.01) |
| *C11D 1/12* | (2006.01) |
| *C11D 1/825* | (2006.01) |
| *C11D 1/75* | (2006.01) |

(52) U.S. Cl.

CPC ..... *C11D 1/8305* (2013.01); *C11D 1/12* (2013.01); *C11D 1/662* (2013.01); *C11D 1/722* (2013.01); *C11D 1/74* (2013.01); *C11D 1/75* (2013.01); *C11D 1/8255* (2013.01); *C11D 11/0023* (2013.01)

(58) Field of Classification Search

CPC ..... C11D 1/8305; C11D 1/722; C11D 1/8255; C11D 1/12; C11D 1/74; C11D 1/75; C11D 1/662; C11D 11/0023; B08B 3/04

See application file for complete search history.

(56) References Cited

U.S. PATENT DOCUMENTS

| | | | | |
|---|---|---|---|---|
| 6,531,442 | B1 | 3/2003 | Durbut et al. | |
| 6,602,838 | B1 | 8/2003 | Koester et al. | |
| 7,871,971 | B1 | 1/2011 | Koester et al. | |
| 2010/0305018 | A1* | 12/2010 | Bittner | C08G 65/2609 510/220 |
| 2011/0143988 | A1* | 6/2011 | Brooker | C11D 1/667 510/224 |
| 2016/0120387 | A1* | 5/2016 | Deleersnyder | C11D 1/74 134/6 |
| 2016/0122688 | A1* | 5/2016 | Di Capua | C11D 1/8305 134/26 |

FOREIGN PATENT DOCUMENTS

| | | | | |
|---|---|---|---|---|
| CA | 2697720 | A1 * | 3/2009 | C08G 65/2609 |
| EP | 2 420 558 | A1 | 2/2012 | |
| EP | 3015540 | A2 * | 5/2016 | C11D 1/83 |
| WO | WO 97/31093 | A1 | 8/1997 | |
| WO | WO 97/38957 | A1 | 10/1997 | |
| WO | WO 00/66684 | A1 | 11/2000 | |
| WO | WO 03/004594 | A1 | 1/2003 | |
| WO | WO03/089563 | * | 10/2003 | C11D 17/04 |
| WO | WO 03/089563 | A2 | 10/2003 | |
| WO | WO 2009/027456 | A2 | 3/2009 | |
| WO | WO 2009/078867 | A1 | 6/2009 | |
| WO | WO 2011/071994 | A2 | 6/2011 | |
| WO | WO 2011/084319 | A1 | 7/2011 | |

OTHER PUBLICATIONS

European Search Report; Application No. 15183431.4; dated Jul. 1, 2016; 16 pages.

Extended European Search Report; Application No. 14190783.2-1357; dated Jun. 16, 2015; 12 pages.

* cited by examiner

*Primary Examiner* — Sharidan Carrillo

(74) *Attorney, Agent, or Firm* — Abbey A. Lopez

(57) ABSTRACT

The need for a liquid hard surface cleaning composition which provides improved shine, reduced slipperiness during drying, and also improved drying times is met formulating the composition using a ethoxylated alkoxylated nonionic surfactant, in combination with a detersive surfactant.

5 Claims, No Drawings

HARD SURFACE CLEANERS COMPRISING ETHOXYLATED ALKOXYLATED NONIONIC SURFACTANTS

FIELD OF THE INVENTION

Hard surface cleaning compositions comprising ethoxylated alkoxylated nonionic surfactants and their use in improving shine on hard surfaces, improving drying time and hence reducing slipperiness.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible. However, it has historically been challenging to formulate a hard surface cleaning composition which effectively cleans tiles, and more delicate surfaces such as stainless steel, linoleum, marble, and the like. Hard surface cleaning compositions are typically diluted before use in a bucket before being applied to the surface being cleaned using a mop, sponge, cloth or similar device. Especially when cleaning particularly dirty floors, film and streak residues may be left which result in poor shine, and an impression that the surface is not yet sufficiently clean. In addition, such floors, washed with diluted hard surface cleaning compositions, tend to be slippery with a resultant increase in the risk of falls and similar accidents. As a result, the floor is sometimes rinsed again using fresh water, in order to remove such films and streaks, and improve the impression of cleanliness. Moreover, long drying times can result in damage to delicate surfaces, such as spotting and rusting of steel surfaces.

Hence, a need remains for a composition which provides improved shine, even after cleaning especially dirty floors. In addition, a need remains for a hard surface cleaning composition which is suitable for cleaning a variety of surfaces, and results in surfaces which are quicker drying.

WO2011/084319 and WO2011/071994 relate to automatic dishwashing detergent powders which comprise nonionic polymeric surfactants.

SUMMARY OF THE INVENTION

The present invention relates to a liquid hard surface cleaning composition comprising: a ethoxylated alkoxylated nonionic surfactant, wherein the ethoxylated alkoxylated nonionic surfactant provides a wetting effect of from 60 to 200, the wetting effect being measured according to EN 1772, using 1 g/l of the ethoxylated alkoxylated nonionic surfactant in distilled water, at 23° C., with 2 g soda/l; an additional nonionic surfactant selected from the group consisting of: an alkyl ethoxylated alcohol, alkyl polyglycosides, amine oxide, and mixture thereof; and an anionic surfactant.

The present invention further relates to a method of improving shine, or reducing drying time of a hard surface, comprising the steps of: diluting a liquid hard surface cleaning composition comprising an ethoxylated alkoxylated nonionic surfactant and a detersive surfactant, to a dilution level of from 0.1% to 2% by volume, and applying the diluted composition to a hard surface.

The present invention further relates to the use of such compositions for improving surface shine.

DETAILED DESCRIPTION OF THE INVENTION

Hard surface cleaning compositions of the present invention, comprising a ethoxylated alkoxylated nonionic surfactant and an additional nonionic surfactant in combination with an anionic surfactant, provide improved shine, even when cleaning especially dirty floors. In addition, they are effective at cleaning a variety of surfaces. Moreover, since surfaces which are treated with the hard surface cleaning composition of the present invention dry more quickly, there is less risk of slips and other accidental falls.

As defined herein, "essentially free of" a component means that no amount of that component is deliberately incorporated into the respective premix, or composition. Preferably, "essentially free of" a component means that no amount of that component is present in the respective premix, or composition.

As used herein, "isotropic" means a clear mixture, having little or no visible haziness, phase separation and/or dispersed particles, and having a uniform transparent appearance.

As defined herein, "stable" means that no visible phase separation is observed for a premix kept at 25° C. for a period of at least two weeks, or at least four weeks, or greater than a month or greater than four months, as measured using the Floc Formation Test, described in USPA 2008/0263780 A1.

All percentages, ratios and proportions used herein are by weight percent of the premix, unless otherwise specified. All average values are calculated "by weight" of the premix, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid Hard Surface Cleaning Compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions. Therefore, they may comprise from 30% to 99.5% by weight of the total composition of water, preferably from 50% to 98% and more preferably from 80% to 97%.

The compositions of the present invention preferably have a viscosity from 1 cps to 650 cps, more preferably of from 100 cps to 550 cps, more preferably from 150 cps to 450 cps, even more preferably from 150 cps to 300 cps and most preferably from 150 cps to 250 cps when measured at 20° C. with a AD1000 Advanced Rheometer from Atlas® shear rate 10 $s^{-1}$ with a coned spindle of 40 mm with a cone angle 2° and a truncation of ±60 μm.

The pH is preferably from 7.0 to 12, more preferably from 7.5 to 11.5, even more preferably from 9.5 to 11.3, most preferably 10 to 11. It is believed that the greasy soil and particulate greasy soil cleaning performance is further improved at these preferred alkaline pH ranges. Accordingly, the compositions herein may further comprise an acid or base to adjust pH as appropriate.

A suitable acid for use herein is an organic and/or an inorganic acid. A preferred organic acid for use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.01% to 5.0% by weight of the total composition, preferably from 0.04% to 3.0% and more preferably from 0.05% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof).

Typical levels of such bases, when present, are from 0.01% to 5.0% by weight of the total composition, preferably from 0.05% to 3.0% and more preferably from 0.1% to 2.0%.

The total amount of surfactant, excluding the ethoxylated alkoxylated nonionic surfactant, is preferably from 2 to 20, more preferably from 3 to 15 and most preferably from 5 to 12% by weight of the composition.

The weight ratio of anionic surfactant to additional nonionic surfactant is preferably from 0.06 to 1.00, more preferably from 0.08 to 0.80, more preferably from 0.10 to 0.60, and most preferably from 0.12 to 0.50.

All ratios are calculated as a weight/weight level, unless otherwise specified.

Preferably, the liquid hard surface cleaner has a turbidity of from 5 NTU to less than 3000 NTU, preferably less than 1000 NTU, more preferably less than 500 NTU and most preferably less than 100 NTU.

Ethoxylated Alkoxylated Nonionic Surfactant:

The liquid hard surface cleaning composition comprises an ethoxylated alkoxylated nonionic surfactant. Preferably, the liquid hard surface cleaning composition comprises the ethoxylated alkoxylated nonionic surfactant at a level of from 0.01 to 10% wt %, more preferably from 0.02 to 5 wt %, most preferably from 0.05 to 3 wt % of the composition. The ethoxylated alkoxylated nonionic surfactant is preferably selected from the group consisting of: esterified alkyl alkoxylated surfactant; alkyl ethoxy alkoxy alcohol, wherin the alkoxy part of the molecule is preferably propoxy, or butoxy, or propoxy-butoxy; polyoxyalkylene block copolymers, and mixtures thereof.

The preferred ethoxylated alkoxylated nonionic surfactant is an esterified alkyl alkoxylated surfactant of general formula (I):

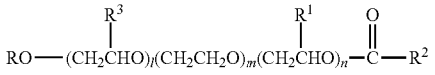

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^3$ and $R^1$ are hydrogen $R^2$ is an unbranched alkyl radical having 5 to 17 carbon atoms; preferably from 6 to 14 carbon atoms 1, n independently of one another, are a number from 1 to 5 and m is a number from 8 to 50; and Preferably, the weight average molecular weight of the ethoxylated alkoxylated nonionic surfactant of formula (I) is from 950 to 2300 g/mol, more preferably from 1200 to 1900 g/mol.

R is preferably from 12 to 15, preferably 13 carbon atoms. $R^3$ and $R^1$ are preferably hydrogen. 1 is preferably 5. n is preferably 1. m is preferably from 13 to 35, more preferably 15 to 25, most preferably 22.. $R^2$ is preferably from 6 to 14 carbon atoms.

The hard surface cleaning composition of the invention provides especially good shine when the esterified alkyl akoxylated surfactant is as follows: R has from 12 to 15, preferably 13 carbon atoms, $R^3$ is hydrogen, $R^1$ is hydrogen, 1 is 5, n is 1, m is from 15 to 25, preferably 22 and $R^2$ has from 6 to 14 carbon atoms and the alcohol ethoxylated has an aliphatic alcohol chain containing from 10 to 14, more preferably 13 carbon atoms and from 5 to 8, more preferably 7 molecules of ethylene oxide.

Another preferred ethoxylated alkoxylated nonionic surfactant is an alkyl ethoxy alkoxy alcohol, preferably wherein the alkoxy part of the molecule is propoxy, or butoxy, or propoxy-butoxy. More preferred alkyl ethoxy alkoxy alcohols are of formula (II):

Formula (II)

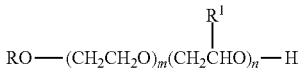

wherein:

R is a branched or unbranched alkyl radical having 8 to 16 carbon atoms;

$R^1$ is a branched or unbranched alkyl radical having 1 to 5 carbon atoms;

n is from 1 to 10; and m is from 6 to 35.

R is preferably from 12 to 15, preferably 13 carbon atoms. $R^1$ is preferably a branched alkyl radical having from 1 to 2 carbon atoms. n is preferably 1 to 5. m is preferably from 8 to 25. Preferably, the weight average molecular weight of the ethoxylated alkoxylated nonionic surfactant of formula (II) is from 500 to 2000g/mol, more preferably from 600 to 1700 g/mol, most preferably 800 to 1500 g/mol.

The ethoxylated alkoxylated nonionic surfactant can be a polyoxyalkylene copolymer. The polyoxyalkylene copolymer can be a block-heteric ethoxylated alkoxylated nonionic surfactant, though block-block surfactants are preferred.

Suitable polyoxyalkylene block copolymers include ethylene oxide/propylene oxide block polymers, of formula (III):

$(EO)_x(PO)_y(EO)_x$, or $(PO)_x(EO)_y(PO)_x$ wherein EO represents an ethylene oxide unit, PO represents a propylene oxide unit, and x and y are numbers detailing the average number of moles ethylene oxide and propylene oxide in each mole of product. Such materials tend to have higher molecular weights than most non-ionic surfactants, and as such can range between 1000 and 30000 g/mol, although the molecular weight should be above 2200 and preferably below 13000 to be in accordance with the invention. A preferred range for the molecular weight of the polymeric non-ionic surfactant is from 2400 to 11500 Daltons. BASF (Mount Olive, N.J.) manufactures a suitable set of derivatives and markets them under the Pluronic trademarks. Examples of these are Pluronic (trademark) F77, L62 and F88 which have the molecular weight of 6600, 2450 and 11400 g/mol respectively. An especially preferred example of a useful polymeric non-ionic surfactant is Pluronic (trademark) F77.

Other suitable ethoxylated alkoxylated nonionic surfactants are described in Chapter 7 of Surfactant Science and Technology, Third Edition, Wiley Press, ISBN 978-0-471-68024-6.

The ethoxylated alkoxylated nonionic surfactant provides a wetting effect of from 60 to 200, preferably from 75 to 150. The wetting effect is measured according to EN 1772, using 1 g/l of the ethoxylated alkoxylated nonionic surfactant in distilled water, at 23° C., with 2 g soda/l. Preferred ethoxylated alkoxylated nonionic surfactants include those sold by BASF under the "Plurafac" trademark, such as Plurafac LF 301 (wetting effect of 90 s), LF 401 (wetting effect of 115 s), LF 405 (wetting effect of 100 s), and LF 7319 (wetting effect of 100 s). It is believed that that the combination of an ethoxylated alkoxylated nonionic surfactant having the aforementioned wetting effect, with the additional nonionic surfactant and anionic surfactant, results in beading of the residual wash water on the hard surface, after cleaning, and hence, improved removal of the residual dirt during subsequent wiping. Moreover, the resultant beading results faster drying time and hence less slipperiness. In comparison, non-preferred ethoxylated alkoxylated nonionic surfactants, such as Plurafac LF 300 (wetting effect of 60) results in less shine and longer drying times.

Additional Nonionic Surfactant

The liquid hard surface cleaning composition comprises an additional nonionic surfactant. The additional nonionic surfactant is selected from the group consisting of: alkoxylated nonionic surfactants, alkyl polyglycosides, amine oxides, and mixture thereof. Typically, the liquid hard surface cleaning composition may comprise from 1.0 wt % to 10.0 wt % by weight of the total composition of said additional nonionic surfactant, preferably from 3.0 wt % to 9.5 wt %, more preferably from 4.0 wt % to 9.0 wt % and most preferably from 5.0 wt % to 8.0 wt %.

For dilute compositions, comprising a total amount of surfactant, excluding the ethoxylated alkoxylated nonionic surfactant, of from 2 to 10 wt %, preferably from 2 to 5 wt %, the additional nonionic surfactant is preferably present at a level of from 1.0 wt % to 5.0 wt %, more preferably from 2.0 wt % to 4.0 wt %, most preferably from 2.2 wt % to 3.5 wt % of the liquid hard surface cleaning composition.

It has been discovered that the combination of the ethoxylated alkoxylated nonionic surfactant and the nonionic surfactant result in improved shine, without a loss of cleaning efficacy. The improvement in shine is particularly noticeable when the ethoxylated alkoxylated nonionic surfactant and the additional nonionic surfactant are present in a weight ratio of from 0.03 to 0.5, preferably from 0.035 to 0.2 and more preferably from 0.04 to 0.09 especially when the ethoxylated alkoxylated nonionic surfactant is an esterified alkyl alkoxylated surfactant of formula I.

The hard surface cleaning composition can comprise from 1 wt % to 10 wt %, preferably from 1.5 wt % to 8 wt %, more preferably from 2 wt % to 7 wt % and most preferably from 2 wt % to 6 wt % of the composition of alkoxylated alcohol, preferably ethoxylated alcohol.

Suitable alkoxylated nonionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula RO-$(A)_nH$, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. R can be linear or branched alkyl chain.

Suitable ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2 ; R is a mixture of $C_9$ to $C_{11}$ alkyl chains, n is 10), Dobanol® 91-12 (HLB=14.5 ; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Lialethl® 11-5 (R is a $C_{11}$ alkyl chain, n is 5), Isalchem® 11-5 (R is a mixture of linear and branched C11 alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5 , Neodol® 11-5, Lialeth® 11-21 Lialeth® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Tergitol® surfactants are commercially available from Dow Chemicals.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol nonionic surfactants, produced using the OXO process, have been marketed under the tradename NEODOL® by the Shell Chemical Company. Alternatively, suitable alkoxylated nonionic surfactants can be prepared by other processes such as the Ziegler process, in addition to derivatives of the OXO or Ziegler processes.

Preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, or a $C_{9-11}$ EO8 alkylethoxylate or a mixture thereof. Most preferably, said alkoxylated nonionic surfactant is a $C_{11}$ EO5 alkylethoxylate or a $C_{9-11}$ EO8 alkylethoxylate or a mixture thereof.

Alkyl polyglycosides are biodegradable nonionic surfactants which are well known in the art. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6. Such alkyl polyglycosides provide a good balance between anti-foam activity and detergency. Alkyl polyglycoside surfactants are commercially available in a large variety. An example of a very suitable alkyl poly glycoside product is Planteren APG 600, which is essentially an aqueous dispersion of alkyl polyglycosides wherein n is about 13 and x is about 1.4.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula : $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain. Preferably, the liquid hard surface cleaning composition comprises from 0.05 wt % to 6 wt %, preferably from 0.1 wt % to 5 wt %, more preferably from 0.1 wt % to 4.5 wt % and most preferably from 0.1wt % to 4 wt % of the composition of amine oxide surfactant.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

The additional nonionic surfactant is preferably a low molecular weight nonionic surfactant, having a molecular weight of less than 950 g/mol, more preferably less than 500 g/mol.

Anionic Surfactant:

The liquid hard surface cleaning composition comprises an anionic surfactant. Preferably, the anionic surfactant is selected from the group consisting of: an alkyl sulphate, an alkyl alkoxylated sulphate, a sulphonic acid or sulphonate surfactant, and mixtures thereof. The liquid hard surface cleaning composition can comprise from 0.05 wt % to 5 wt %, preferably from 0.1 wt % to 4 wt %, and most preferably from 1.5 wt % to 3.5 wt % of anionic surfactant.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from Huntsman. By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants for use herein are all those commonly known by those skilled in the art. Preferably, the sulphonated anionic surfactants for use herein are selected from the group consisting of : alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates for use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Clariant. Particularly preferred alkyl aryl sulphonates are alkyl benzene sulphonates commercially available under trade name Nansa® available from Huntsman.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants for use herein are according to the formula $R(A)_mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably $C_{12}$-$C_{16}$ alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_{12}$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant for use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant for use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

Typically, the liquid composition herein may comprise from 0.5% to 9.5% by weight of the total composition of said sulphated or sulphonated anionic surfactant, preferably from 1.0% to 5.0%, more preferably from 1.5% to 3.5% and most preferably from 2.0% to 3.0%.

Additional Surfactant:

The hard surface cleaning composition may comprise up to 15% by weight of an additional surfactant, preferably selected from: an amphoteric, zwitterionic, and mixtures thereof. More preferably, the hard surface cleaning composition can comprise from 0.5% to 5%, or from 0.5% to 3%, or from 0.5% to 2% by weight of the additional surfactant.

Suitable zwitterionic surfactants typically contain both cationic and anionic groups in substantially equivalent proportions so as to be electrically neutral at the pH of use. The typical cationic group is a quaternary ammonium group, other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (such as betaine/sulphobetaine surfacants) are described in U.S. Pat. Nos. 2,082,275, 2,702,279 and 2,255,082. For example Coconut dimethyl betaine is commercially available from Seppic under the trade name of Amonyl 265®. Lauryl betaine is commercially available from Albright & Wilson under the trade name Empigen BB/L®. A further example of betaine is Lauryl-imminodipropionate commercially available from Rhodia under the trade name Mirataine H2C-HA®.

Sulfobetaine surfactants are particularly preferred, since they can improve soap scum cleaning. Examples of suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and ReWoteric AM CAS 15® respectively.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Hydrophile-Lipophile Balance (HLB):

The surfactants of the liquid hard surface cleaning composition, excluding the ethoxylated alkoxylated nonionic surfactant, preferably have an overall hydrophile-lipophile balance (HLB) of from 6 to 36, preferably from 8 to 26, more preferably from 10 to 15. The hydrophile-lipophile balance (HLB) is a method for quantifying the potential surface activity of the surfactant system, based on its molecular constitution, and is described in more detail in section 9.7.1 of Surfactant Science and Technology, Third Edition, Wiley Press, ISBN 978-0-471-68024-6.

Particularly improved shine, in combination with good cleaning, is achieved when a surfactant system, having the above described HLB, is combined with the ethoxylated alkoxylated nonionic surfactant which provides the desired wetting effect. Hence, in a particularly preferred embodiment, the hard surface cleaning composition comprises: from 0.05 wt % to 3.00 wt % of a ethoxylated alkoxylated nonionic surfactant selected from esterified alkyl alkoxylated surfactant of formula (I); from 2wt % to 10 wt % of ethoxylated alcohols from 0.05 wt % to 5 wt % of amine oxide, and from 0.05 wt % to 5 wt % of anionic surfactant.

Optional Ingredients:

Thickener: The liquid hard surface cleaning composition can comprise a thickener. An increased viscosity, especially low shear viscosity, provides longer contact time and therefore improved penetration of greasy soil and/or particulated greasy soil to improve cleaning effectiveness, especially when applied neat to the surface to be treated. Moreover, a high low shear viscosity improves the phase stability of the liquid cleaning composition, and especially improves the stability of the ethoxylated alkoxylated nonionic surfactant in compositions in the liquid hard surface cleaning composition. Hence, preferably, the liquid hard surface cleaning composition, comprising a thickener, has a viscosity of from 50 Pa.s to 650 Pa.s, more preferably 100 Pa.s to 550 Pa.s, most preferably 150 Pa.s to 450 Pa.s, at 20° C. when measured with a AD1000 Advanced Rheometer from Atlas® shear rate 10 $s^{-1}$ with a coned spindle of 40 mm with a cone angle 2° and a truncation of ±60μm.

Suitable thickeners include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose. Suitable hydroxethylcelluloses (HM-HEC) are commercially available from Aqualon/Hercules under the product name Polysurf 76® and W301 from 3V Sigma.

Xanthan gum is one suitable thickener used herein. Xanthan gum is a polysaccharide commonly used rheoligy modifier and stabilizer. Xanthan gum is produced by fermentation of glucose or sucroce by the *xanthomonas campestris* bacterium. Suitable Xanthan gum is commercially available under trade anem Kelzan T® from CP Kelco.

Hydrogenated castor oil is one suitable thickener used herein. Suitable hydrogenated castor oil is available under trade name THIXCIN R from Elementis.

The most preferred thickener used herein is a modified methacrylic acid/acrylic acid copolymer Rheovis® AT 120, which is commercially available from BASF.

When used, the liquid hard surface cleaning composition comprises from 0.1% to 10.0% by weight of the total composition of said thickener, preferably from 0.2% to 5.0%, more preferably from 0.2% to 2.5% and most preferably from 0.2% to 2.0%.

Chelating agent: The liquid hard surface cleaning composition can comprise a chelating agent or crystal growth inhibitor. Suitable chelating agents, in combination with the surfactant system, improve the shine benefit. Chelating agent can be incorporated into the compositions in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents include ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agent to be used herein is diethylene triamine penta methylene phosphonate (DTPMP). Such phosphonate chelating agents are commercially available from Monsanto under the trade name DEQUEST®.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename (S,S)EDDS® from Palmer Research Laboratories. Most preferred biodegradable chelating agent is L-glutamic acid N,N-diacetic acid (GLDA) commercially available under tradename Dissolvine 47S from Akzo Nobel.

Suitable amino carboxylates for use herein include ethylene diamine tetra acetates, diethylene triamine pentaacetates, diethylene triamine pentaacetate (DTPA), N-hydroxyethylethylenenediamine triacetates, nitrilotriacetates, ethylenediamine tetrapropionates, triethylenetetraamine-hexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF. Further carboxylate chelating agents for use herein include salicylic acid, aspartic acid, glutamic acid, glycine, malonic acid or mixtures thereof.

Additional polymers: The liquid hard surface cleaning composition may comprise an additional polymer. It has been found that the presence of a specific polymer as described herein, when present, allows further improving the grease removal performance of the liquid composition due to the specific sudsing/foaming characteristics they provide to the composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid hard surface cleaning composition may comprise from 0.005% to 5.0% by weight of the total composition of said polymer, preferably from 0.10% to 4.0%, more preferably from 0.1% to 3.0% and most preferably from 0.20% to 1.0%.

Fatty acid: The liquid hard surface cleaning composition may comprise a fatty acid as a highly preferred optional ingredient, particularly as suds supressors. Fatty acids are desired herein as they reduce the sudsing of the liquid composition when the composition is rinsed off the surface to which it has been applied.

Suitable fatty acids include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB1211.

Typically, the liquid hard surface cleaning composition may comprise up to 6.0% by weight of the total composition of said fatty acid, preferably from 0.1% to 3.0%, more preferably from 0.1% to 2.0% and most preferably from 0.15% to 1.5% by weight of the total composition of said fatty acid.

Branched fatty alcohol: The liquid hard surface cleaning composition may comprise a branched fatty alcohol, particularly as suds suppressors. Suitable branched fatty alcohols include the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the a position (i.e., position number 2) by an alkyl chain comprising from 1 to 10, preferably from 2 to 8 and more preferably 4 to 6 carbon atoms. Such suitable compounds are commercially available, for instance, as the Isofol® series such as Isofol® 12 (2-butyloctanol) or Isofol® 16 (2-hexyl decanol) commercially available from Sasol Typically, the liquid hard surface cleaning composition may comprise up to 2.0% by weight of the total composition of said branched fatty alcohol, preferably from 0.10% to 1.0%, more preferably from 0.1% to 0.8% and most preferably from 0.1% to 0.5%.

Solvent: The liquid hard surface cleaning compositions preferably comprises a solvent. Suitable solvents may be selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

Perfumes: The liquid hard surface cleaning compositions preferably comprise a perfume. Suitable perfumes provide an olfactory aesthetic benefit and/or mask any "chemical" odour that the product may have.

Other optional ingredients: The liquid hard surface cleaning compositions may comprise a variety of other optional ingredients depending on the technical benefit aimed for and the surface treated. Suitable optional ingredients for use herein include builders, other polymers, buffers, bactericides, hydrotropes, colorants, stabilisers, radical scavengers, abrasives, soil suspenders, brighteners, anti-dusting agents, dispersants, dye transfer inhibitors, pigments, silicones and/or dyes.

Method of Cleaning a Surface:

Liquid hard surface cleaning compositions comprising a ethoxylated alkoxylated nonionic surfactant and at least one other detersive surfactant, especially the compositions of the present invention, are suitable for cleaning household surfaces. In particular, such compositions are particularly useful for improving surface shine, especially of hard surfaces. Suitable detersive surfactants can be selected from the group consisting of: anionic surfactant, nonionic surfactant, and mixtures thereof.

For general cleaning, especially of floors, the preferred method of cleaning comprises the steps of:

a) diluting a liquid hard surface cleaning composition comprising an ethoxylated alkoxylated nonionic surfactant and a detersive surfactant, to a dilution level of from 0.1% to 2% by volume, and b) applying the diluted composition to a hard surface.

In preferred embodiments, the liquid hard surface cleaning composition may be diluted to a level of from 0.3% to 1.5% by volume. The liquid hard surface cleaning composition may be diluted to a level of from 0.4% to 0.6% by volume, especially where the liquid hard surface cleaning composition has a total surfactant level, excluding the ethoxylated alkoxylated non-ionic surfactant, of greater than or equal to 5% by weight. Where the liquid hard surface cleaning composition has a total surfactant level, excluding the ethoxylated alkoxylated non-ionic surfactant, of less than 5% by weight, the liquid hard surface cleaning composition may be diluted to a level of from 0.7% to 1.4% by volume. In preferred embodiments, the liquid hard surface cleaning composition is diluted with water.

The dilution level is expressed as a percent defined as the fraction of the liquid hard surface cleaning composition, by volume, with respect to the total amount of the diluted composition. For example, a dilution level of 5% by volume is equivalent to 50 ml of the liquid hard surface cleaning composition being diluted to form 1000 ml of diluted composition.

The diluted composition can be applied by any suitable means, including using a mop, sponge, or other suitable implement.

The hard surface may be rinsed, preferably with clean water, in an optional further step. Liquid hard surface cleaning compositions comprising a ethoxylated alkoxylated nonionic surfactant and at least one other detersive surfactant, especially the compositions of the present invention, result in improved drying time of the diluted composition applied to the hard surface, and also of any rinse solution which is applied as a further step, both when left to dry and also when wiped, such as with a cloth. The ethoxylated alkoxylated nonionic surfactant results in improved beading of the rinse solution on the hard surface, and hence reduced drying time. The reduced drying time also results in less slipperiness.

Alternatively, and especially for particularly dirty or greasy spots, the liquid hard surface cleaning compositions comprising a ethoxylated alkoxylated nonionic surfactant and at least one other detersive surfactant, especially the compositions of the present invention, can be applied neat to the hard surface. It is believed that the improved surface wetting, provided by the ethoxylated alkoxylated nonionic surfactant, results in improved penetration of the stain, and especially greasy stains, leading to improved surfactancy action and stain removal.

By "neat", it is to be understood that the liquid composition is applied directly onto the surface to be treated without undergoing any significant dilution, i.e., the liquid composition herein is applied onto the hard surface as described herein, either directly or via an implement such as a sponge, without first diluting the composition. By significant dilution, what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In a preferred embodiment of the present invention said hard surface is inclined or vertical.

Inclined or vertical hard surfaces include minors, lavatory pans, urinals, drains, waste pipes and the like.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action, and optionally removing said liquid composition, preferably removing said liquid composition by rinsing said hard surface with water and/or wiping said hard surface with an appropriate instrument, e.g., a sponge, a paper or cloth towel and the like.

The compositions of the present invention can also be used for improving surface shine, since the beading of the composition results in less residue formation on the treated surface, and also greater removal of residues when the surface is wiped.

Methods:

A) pH measurement:

The pH is measured on the neat composition, at 25° C., using a Sartarius PT-10P pH meter with gel-filled probe (such as the Toledo probe, part number 52 000 100), calibrated according to the instructions manual.

B) Shine test for floor cleaning:

The shine test is done with soil mixture which consists of a mixture of consumer relevant soils such as oil, particulates, pet hair, sugar etc. The black glossy ceramic tiles are soiled with the soil mixture and cleaned with the diluted thickened liquid hard surface cleaning composition(s) and, after letting them dry, results are analyzed by using grading scale described below.

| Grading in absolute scale: | and PSU Scale (average of 3 graders): |
|---|---|
| 0 = as new/no streaks and/or film | 0 = I see no difference |
| 1 = very slight streaks and/or film | 1 = I think there is difference |
| 2 = slight streaks and/or film | 2 = I am sure there is a slight difference |
| 3 = slight to moderate streaks and/or film | 3 = I am sure there is a difference |
| 4 = moderate streaks and/or film | 4 = I am sure there is a big difference |
| 5 = moderate/heavy streaks and/or film | |
| 6 = heavy streaks and/or film | |

C) Drying Time:

While performing the Shine test under soiled conditions, in a controlled temperature and humidity room at 20° C. and a relative humidity of 40% the time taken for the tiles to completely dry is measured.

D) Turbidity (NTU):

The turbidity (measured in NTU: Nephelometric Turbidity Units) is measured using a Hach 2100P turbidity meter calibrated according to the procedure provided by the manufacture. The sample vials are filled with 15 ml of representative sample and capped and cleaned according to the operating instructions. If necessary, the samples are degassed to remove any bubbles either by applying a vacuum or using an ultrasonic bath (see operating manual for procedure). The turbidity is measured using the automatic range selection.

EXAMPLES

Example 1 was prepared as a comparative formulation. Examples 2 and 3 were prepared as compositions of the present invention.

Comparative example 1 comprised 6.2 wt % of an ethoxylated alcohol and 1.5 wt % of an amine oxide, as non-ionic surfactants, in addition to 1.8 wt % of HLAS as anionic surfactant. Example 2 was formulated with the same ingredients, at the same level as example 1, except that the ethoxylated alcohol level was reduced to 5.7 wt % of the composition, and 0.5 wt % of an ethoxylated alkoxylated non-ionic surfactant of formula I (Plurafac LF7319, having a wetting effect of 100) was added instead. As such, the ratio of ethoxylated alkoxylated nonionic surfactant to additional nonionic surfactant for example 2 is 0.069. Example 3 was formulated with the same ingredients, at the same level as example 1, except that the ethoxylated alcohol level was reduced to 4.1 wt % of the composition, and 2.1 wt % of an ethoxylated alkoxylated non-ionic surfactant of formula I (Plurafac LF7319, having a wetting effect of 100) was added instead. As such, the ratio of ethoxylated alkoxylated non-ionic surfactant to additional nonionic surfactant for example 2 is 0.375.

| | Ex 1* wt % | Ex 2 wt % | Ex 3 wt % |
|---|---|---|---|
| C9/11 EO8 | 6.2 | 5.74 | 4.13 |
| HLAS | 1.80 | 1.80 | 1.80 |
| C12-14 Amine Oxide | 1.50 | 1.50 | 1.50 |
| Plurafac LF7319 | — | 0.46 | 2.07 |
| Hydrophobically modified-polyacrylate[1] | 0.8 | 0.8 | 0.8 |

-continued

| | Ex 1* wt % | Ex 2 wt % | Ex 3 wt % |
|---|---|---|---|
| $Na_2CO_3$ | 0.55 | 0.55 | 0.55 |
| Citric Acid | 0.30 | 0.30 | 0.30 |
| Topped palm kernel fatty acid | — | — | — |
| Coconut fatty acid | 0.40 | 0.40 | 0.40 |
| DTPMP[2] | — | — | — |
| DTPA[3] | 0.25 | 0.25 | 0.25 |
| Perfume | 1.10 | 1.10 | 1.10 |
| Caustic | to pH 10.3 | to pH 10.3 | to pH 10.3 |
| Minors and Water | to 100% | to 100% | to 100% |

*Comparative

[1]Stucturant commercially available from BASF

[2]Diethylenetriaminepenta(methylene-phosphonic acid) commercially available from Therm Phos international BV

[3]Diethylene triamine pentaacetic acid commercially available form Dow chemical Examples 1 to 3 were evaluated for shine benefit under soiled conditions, using the procedure described above (Shine test for floor cleaning). The results are given below. For the absolute grading, a lower score indicates improved shine, as described in the test method. For the PSU grading, Example 1 was used as the reference. For the PSU grading, a higher score indicates improved shine. Examples 1 to 3 were also evaluated for drying time, using the method described above (Drying Time), and the results are also given in the table below:

TABLE 1

| | Shine result: Absolute grading | Shine result: PSU grading | Drying time |
|---|---|---|---|
| Example 1 (Comparative) | 5.0 | Reference | 85.7 s |
| Example 2 (of invention) | 3.0 | +3.3 | 64.3 s |
| Example 3 (of invention) | 3.8 | +2.3 | 70.3 s |

As can be seen in table 1, the addition of an ethoxylated alkoxylated non-ionic surfactant to the hard surface cleaning composition results in both improved shine, in addition to a reduction in drying time. When the ethoxylated alkoxylated nonionic surfactant is added, such that the ratio of ethoxylated alkoxylated nonionic surfactant to additional nonionic surfactant is between 0.035 to 0.2, the improvement in shine is particularly noticeable.

The following ethoxylated alkoxylated non-ionic surfactants have been found to provide improvements in shine: Plurafac LF 132, Plurafac LF 305, Plurafac LF 7319, Plurafac LF 224, Plurafac LF 120, Plurafac LF 131, Plurafac LF 220, Plurafac LF 221, Plurafac LF 223, Plurafac LF 300, Plurafac LF 303, Plurafac LF 400, Plurafac LF 404, Plurafac LF 431, Plurafac LF 500, Plurafac LF 900, Dowfax 63N10, Dowfax 20A612, Dowfax 20A42. As such, they are particularly suitable for use in liquid hard surface cleaning compositions, including the compositions exemplified in examples A to I below:

| | A wt % | B wt % | C wt % | D wt % | E wt % | F wt % | G wt % | H wt % | I wt % |
|---|---|---|---|---|---|---|---|---|---|
| C9/11 EO8[4] | 1.2 | — | 7.0 | — | — | — | 6.0 | 6.0 | 6.2 |
| C9/11EO5[5] | — | — | — | 3.5 | — | — | — | — | — |
| C13/15 EO30[6] | — | — | — | 3.5 | — | — | — | — | — |
| C8/10 EO8[7] | 1.2 | 2.4 | — | — | 7.0 | 6.0 | — | — | — |
| NaLAS[8] | 0.4 | 0.6 | 1.8 | — | — | 2.60 | — | 2.25 | 1.80 |
| NAPS[9] | — | — | — | 3.1 | 3.0 | — | 2.60 | — | — |
| C12-14 Amine Oxide[10] | 0.15 | — | 1.50 | 3.9 | 2.0 | 0.5 | 0.5 | 1.25 | 1.50 |
| C12-14 Betaine[11] | — | — | — | — | 1.0 | — | 0.5 | — | — |
| ethoxylated alkoxylated non-ionic surfactant | 0.2 | 0.1 | 0.5 | 1.0 | 0.4 | 0.3 | 0.5 | 0.7 | 0.5 |
| Hydrophobically modified-polyacrylate[1] | — | — | 0.75 | — | — | — | 0.70 | 0.65 | 0.65 |
| HM-HEC[12] | — | — | — | 0.6 | 0.8 | — | — | — | — |
| Xanthan gum[13] | — | — | — | — | — | 0.42 | — | — | — |
| $Na_2CO_3$ | 0.40 | 0.4 | 0.75 | 0.1 | 0.3 | 0.50 | 0.55 | 0.4 | 0.55 |
| Citric Acid | 0.30 | 0.3 | 0.3 | 0.75 | 0.75 | 0.30 | 0.3 | 0.3 | 0.30 |
| Caustic | 0.25 | 0.25 | 0.72 | 0.5 | 0.5 | 0.3 | 0.65 | 0.65 | 0.66 |
| Fatty Acid | 0.15 | — | 1.0 | 0.20 | 0.50 | 0.50 | 0.40 | 0.40 | 1.0 |
| 2-butyl octanol[14] | — | 0.2 | 0.1 | 0.2 | 0.3 | 0.5 | — | — | 0.1 |
| 2-hexyl decanol[15] | — | — | — | — | — | — | 0.1 | — | — |
| DTPMP[2] | 0.1 | 0.15 | 0.30 | — | — | 0.2 | — | — | 0.3 |
| DTPA[3] | — | — | — | — | — | — | 0.25 | 0.25 | — |
| GLDA[18] | — | — | — | 0.3 | 0.3 | — | — | — | — |
| IPA[17] | — | — | — | — | — | 2.0 | — | — | — |
| n-BPP[18] | — | — | — | — | 2.0 | — | — | — | — |
| n-BP[19] | — | — | — | 4.0 | 2.0 | — | — | 2.0 | — |
| Minors and Water | up to 100% | up to 100% | up to 100% | up to 100% | up to 100% | up to 100% | up to 100% | up to 100% | up to 100% |
| pH | 10.5 | 10.3 | 10.3 | 9.5 | 9.0 | 10.5 | 10.3 | 10.5 | 10.3 |

[4]nonionic surfactant commercially available from Shell.
[5]nonionic surfactant commercially available from ICI or Shell.
[6]nonionic surfactant commercially available from BASF
[7]nonionic surfactant commercially available from Sasol
[8]sodium linear alkylbenzene sulphonate commercially available from Huntsman
[9]sodium paraffin sulphonate commercially available from ICS
[10]amine oxide nonionic surfactant commercially available from Huntsman
[11]amphoteric surfactant commercially available from MC Intyre group
[12]Hydrophobically modified hydroxyethylcellulose (cetylhydroxethylcellulose)
[13]commercially available from CP Kelco
[14]commercially available from Sasol as Isofol 12 ®.
[15]commercially available from Sasol as Isofol 16 ®.
[16]Tetrasodium Glutamate Diacetate, commercially available from Akzo Nobel
[17]isopropanol, commercially available from J T Baker
[18]butoxy propoxy propanol, commercially available from Dow Chemicals
[19]normal butoxy propanol commercially available from Dow Chemicals The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of improving shine, or reducing drying time of a hard surface, comprising the steps of:

diluting a liquid hard surface cleaning composition comprising an ethoxylated alkoxylated nonionic surfactant, amine oxide, and an anionic surfactant, to a dilution level of from about 0.1% to about 2% by volume, wherein the ethoxylated alkoxylated nonionic surfactant is an alkyl ethoxy alkoxy alcohol of formula (II):

Formula (II)

$$RO-(CH_2CH_2O)_m(CH_2\overset{\overset{R^1}{|}}{C}HO)_n-H$$

wherein:

R is a branched or unbranched alkyl radical having about 8 to about 16 carbon atoms;

$R^1$ is a branched or unbranched alkyl radical having about 1 to about 5 carbon atoms;

n is a number from about 1 to about 10; and m is a number from about 6 to about 35 and the ethoxylated alkoxylated nonionic surfactant provides a wetting effect of from about 60 to about 200, the wetting effect being measured according to EN 1772, using about 1 g/l of the ethoxylated alkoxylated nonionic surfactant in distilled water, at about 23° C., with about 2 g soda/l, and (b) applying the diluted composition to a hard surface.

2. The method of claim 1, comprising the further step of:

(c) rinsing the hard surface with water.

3. The method of claim 1, wherein the hard surface is selected from the group consisting of: floors, walls, tiles, windows, cupboards, sinks, showers, shower plastified curtains, wash basins, water closet, fixtures and fittings, appliances, and combinations thereof.

4. A method of improving shine, or reducing drying time of a hard surface, comprising the steps of:

diluting a liquid hard surface cleaning composition comprising:

a. from 0.01 wt. % to 10 wt % of an esterified alkyl alkoxylated surfactant of formula (I):

Formula (I)

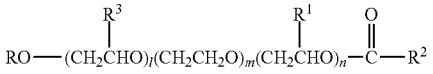

wherein:

R is a branched or unbranched alkyl radical having about 8 to about 16 carbon atoms;

$R^3$, $R^1$ independently of one another, are hydrogen or a branched or unbranched alkyl radical having about 1 to about 5 carbon atoms;

$R^2$ is an unbranched alkyl radical having about 5 to about 17 carbon atoms;

l, n independently of one another, are a number from about 1 to about 5; and m is a number from about 8 to about 50;

b. an additional nonionic surfactant blend comprising an alkyl ethoxylated alcohol and amine oxide, wherein the alkyl ethoxylated alcohol is present in the liquid hard surface cleaning composition at about 1.0 wt % to about 10.0 wt %, based on the weight of the liquid hard surface cleaning composition, and the amine oxide is present in the liquid hard surface cleaning composition at about 0.05 wt % to about 6 wt %, based on the weight of the liquid hard surface cleaning composition, wherein the esterifield alkyl alkoxylated surfactant and the additional nonionic surfactant blend are present in a weight ratio of from 0.03 to 0.5; and c. from about 0.05 wt % to about 5 wt % of an anionic surfactant, based on the weight of the liquid hard surface cleaning composition; and applying the diluted composition to a hard surface.

5. The method of claim 4, wherein the hard surface is selected from the group consisting of: floors, walls, tiles, windows, cupboards, sinks, showers, shower plastified curtains, wash basins, water closet, fixtures and fittings, appliances, and combinations thereof.

* * * * *